US011111613B2

(12) United States Patent
Higuchi et al.

(10) Patent No.: US 11,111,613 B2
(45) Date of Patent: Sep. 7, 2021

(54) SHEET MANUFACTURING APPARATUS, AND SHEET MANUFACTURING METHOD

(71) Applicant: SEIKO EPSON CORPORATION, Tokyo (JP)

(72) Inventors: Naotaka Higuchi, Fujimi-machi (JP); Masahide Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 15/756,645

(22) PCT Filed: Aug. 30, 2016

(86) PCT No.: PCT/JP2016/003934
§ 371 (c)(1),
(2) Date: Mar. 1, 2018

(87) PCT Pub. No.: WO2017/038077
PCT Pub. Date: Mar. 9, 2017

(65) Prior Publication Data

US 2018/0251926 A1 Sep. 6, 2018

(30) Foreign Application Priority Data

Sep. 4, 2015 (JP) ..... JP2015-174443

(51) Int. Cl.
*D04H 1/732* (2012.01)
*B27N 3/18* (2006.01)
(Continued)

(52) U.S. Cl.
CPC ..... *D04H 1/732* (2013.01); *B27N 3/04* (2013.01); *B27N 3/12* (2013.01); *B27N 3/18* (2013.01); *B27N 3/007* (2013.01)

(58) Field of Classification Search
CPC . D04H 1/732; B27N 3/12; B27N 3/04; B27N 3/18; B27N 3/007
See application file for complete search history.

(56) References Cited

U.S. PATENT DOCUMENTS 2,925,360 A * 2/1960 Roberts ..... B27N 3/14 264/518
4,352,649 A * 10/1982 Jacobsen ..... D04H 1/736 19/296
(Continued)

FOREIGN PATENT DOCUMENTS

DE 196 35 410 A1 3/1998
JP 2003-227089 A 8/2003
(Continued)

OTHER PUBLICATIONS

The Extended European Search Report for the corresponding European Patent Application No. 16841111.4 dated Apr. 10, 2019.

*Primary Examiner* — Timothy Kennedy
*Assistant Examiner* — Olukorede Esan
(74) *Attorney, Agent, or Firm* — Global IP Counselors, LLP

(57) ABSTRACT

Provided is a sheet manufacturing apparatus that can suppress deposited material from wrapping onto a roller. A sheet manufacturing apparatus according to the invention includes: an air-laying unit that lays material containing fiber and resin; and a humidifying unit that humidifies the deposited material laid by the air-laying unit; the humidifying unit including a first air flow generator that generates air flow passing through the deposited material in a direction intersecting the support surface supporting the deposited material, and supplies droplets or humidified air to the deposited material by the air flow produced by the first air flow generator.

9 Claims, 3 Drawing Sheets

(51) Int. Cl.

| | |
|---|---|
| ***B27N 3/04*** | (2006.01) |
| ***B27N 3/12*** | (2006.01) |
| ***B27N 3/00*** | (2006.01) |

(56) References Cited

U.S. PATENT DOCUMENTS

| | | | | |
|---|---|---|---|---|
| 2005/0242465 | A1* | 11/2005 | Arai | B29D 7/01 264/216 |
| 2014/0027075 | A1 | 1/2014 | Yamagami et al. | |
| 2014/0290886 | A1* | 10/2014 | Nagai | D21H 25/04 162/252 |
| 2015/0204015 | A1 | 7/2015 | Gomi et al. | |

FOREIGN PATENT DOCUMENTS

| | | | |
|---|---|---|---|
| JP | 2012-144819 | A | 8/2012 |
| JP | 2014-208923 | A | 11/2014 |
| JP | 2015-137437 | A | 7/2015 |
| JP | 2016-079533 | A | 5/2016 |
| JP | 2016-098472 | A | 5/2016 |

* cited by examiner

SHEET MANUFACTURING APPARATUS, AND SHEET MANUFACTURING METHOD

CROSS-REFERENCE TO RELATED APPLICATIONS

This application is a U.S. National stage application of International Patent Application No. PCT/JP2016/003934, filed on Aug. 30, 2016, which claims priority under 35 U.S.C. § 119(a) to Japanese Patent Application No. 2015-174443, filed in Japan on Sep. 4, 2015. The entire disclosure of Japanese Patent Application No. 2015-174443 is hereby incorporated herein by reference.

TECHNICAL FIELD

The present invention relates to a sheet manufacturing apparatus, and a sheet manufacturing method.

BACKGROUND

Sheet manufacturing apparatuses conventionally use a slurry process in which feedstock including fiber is soaked in water, defibratedbyprimarily a mechanical action, and then rescreened. Sheet manufacturing apparatuses using such wet slurry methods require a large amount of water, and are large. Maintenance of the water processing system is also laborious, and the drying process requires much energy.

Dry process sheet manufacturing apparatuses that use little to no water have therefore been proposed to reduce equipment size and energy consumption. For example, JP-A-2012-144819 describes defibrating pieces of paper into fibers in a dry-process defibrator, deinking the fibers in a cyclone separator, passing the deinked fiber through a foraminous screen on the surface of a forming drum, and laying the fiber on a mesh belt using the suction of a suction device to form paper. The technology described in JP-A-2012-144819 strengthens the hydrogen bonds between fibers by misting the sheet of deinked fiber laid on the mesh belt with water by means of a water sprayer.

SUMMARY

However, when water drops are simply sprayed onto the deposited material accumulated on the mesh belt as described in JP-A-2012-144819, much water sticks to the surface of the deposited material, and the deposited fiber then sticks to downstream rollers.

An objective of the several embodiments of the present invention is to provide a sheet manufacturing apparatus sheet that can suppress adhesion of the deposited material to the rollers. Another objective of the several embodiments of the present invention is to provide a sheet manufacturing method sheet that can suppress adhesion of the deposited material to the rollers.

The present invention is directed to solving at least part of the foregoing problem, and can be embodied as described in the following claims and examples.

A first aspect of the invention of a sheet manufacturing apparatus according to the invention includes: an air-laying unit that lays material containing fiber and resin; and a humidifying unit that humidifies the deposited material laid by the air-laying unit; the humidifying unit including a first air flow generator that generates air flow passing through the deposited material in a direction intersecting the support surface supporting the deposited material, and supplies droplets or humidified air to the deposited material by the air flow produced by the first air flow generator.

A sheet manufacturing apparatus thus comprised can humidify deposited material to the inside by the air flow produced by the first air flow generator, and can suppression water droplets and moisture adhering to only the surface of the deposited material. A sheet manufacturing apparatus thus comprised can therefore moisten the deposited material uniformly through the thickness thereof, and, compared with simply misting water droplets to deposit water droplets or moisture on only the surface of the deposited material, can reduce the amount of water droplets and moisture on the surface of the deposited material. As a result, deposited material wrapping onto rollers can be suppressed in this sheet manufacturing apparatus.

In a sheet manufacturing apparatus according to another aspect of the invention, the air-laying unit has a first housing that defines a deposition area for depositing the material; and the humidifying unit has a second housing that defines a humidifying area for humidifying the deposited material.

A sheet manufacturing apparatus thus comprised can suppress excessive humidifying the inside of the second housing by the humidifying unit, and can suppress a drop in the quality of the manufactured sheet.

In a sheet manufacturing apparatus according to another aspect of the invention, the first air flow generator is a first suction device disposed on the back side, which faces the opposite side as the support surface; and the air-laying unit has a second suction device disposed on the back side and configured to produce air flow causing the material to accumulate on the support surface.

The sheet manufacturing apparatus thus comprised can separately set the volume and velocity of the air flow produced by the first suction device, and the volume and velocity of the air flow produced by the second suction device.

In a sheet manufacturing apparatus according to another aspect of the invention, the air-laying unit has a second air flow generator that produces air flow causing the material to accumulate on the support surface; and the first air flow generator and second air flow generator are a common suction device disposed on the back side, which faces the opposite side as the support surface.

This configuration enables reducing the size of the sheet manufacturing apparatus.

In a sheet manufacturing apparatus according to another aspect of the invention, the air-laying unit has a first roller that contacts the deposited material; and the humidifying unit has a second roller that contacts the humidified deposited material; and the surface free energy of the second roller is less than the surface free energy of the first roller.

Even if the deposited material is humidified by the humidifying unit and more easily wraps onto the roller, the sheet manufacturing apparatus thus comprised can suppress wrapping of the deposited material onto the second roller.

In a sheet manufacturing apparatus according to another aspect of the invention, the air-laying unit has a second air flow generator configured to produce air flow causing the material to accumulate on the support surface; and the velocity of the air flow produced at the support surface by the first air flow generator is less than the velocity of the air flow produced at the support surface by the second air flow generator.

The sheet manufacturing apparatus in this configuration can improve the quality of the manufactured sheet while suppressing separation of the fiber and resin.

A sheet manufacturing apparatus according to another aspect of the invention has an air-laying unit configured to lay on a support surface material containing fiber and resin; a generator configured to produce droplets or humidified air from the support surface side; and a first suction device configured to suction the droplets or humidified air produced by the generator from the back side, which faces the opposite direction as the support surface.

A sheet manufacturing apparatus thus comprised can efficiently humidify to the inside the deposited material formed on the support surface, and can thereby suppress the deposited material from wrapping onto the roller.

In a sheet manufacturing apparatus according to another aspect of the invention, the air-laying unit has a foraminous drum unit; and a second suction device configured to suction, from the back side, material that has passed through openings in the drum unit.

The sheet manufacturing apparatus thus configured can suppress deposited material from wrapping onto the roller.

Another aspect of the invention is a sheet manufacturing method including a step of laying material containing fiber and resin; and a step of humidifying the deposited material; the step of humidifying the deposited material supplying droplets or humidified air to the deposited material by the air flow passing through the deposited material in a direction intersecting the support surface supporting the deposited material.

The sheet manufacturing method thus comprised can suppress deposited material from wrapping onto the roller.

DESCRIPTION OF EMBODIMENTS

Preferred embodiments of the invention are described below with reference to the accompanying figures. Note that the embodiments described below do not unduly limit the scope of the invention described in the accompanying claims. All configurations described below are also not necessarily essential elements of the invention.

1. Embodiment 1

1.1. Sheet Manufacturing Apparatus

1.1.1. Configuration

Figure 1:
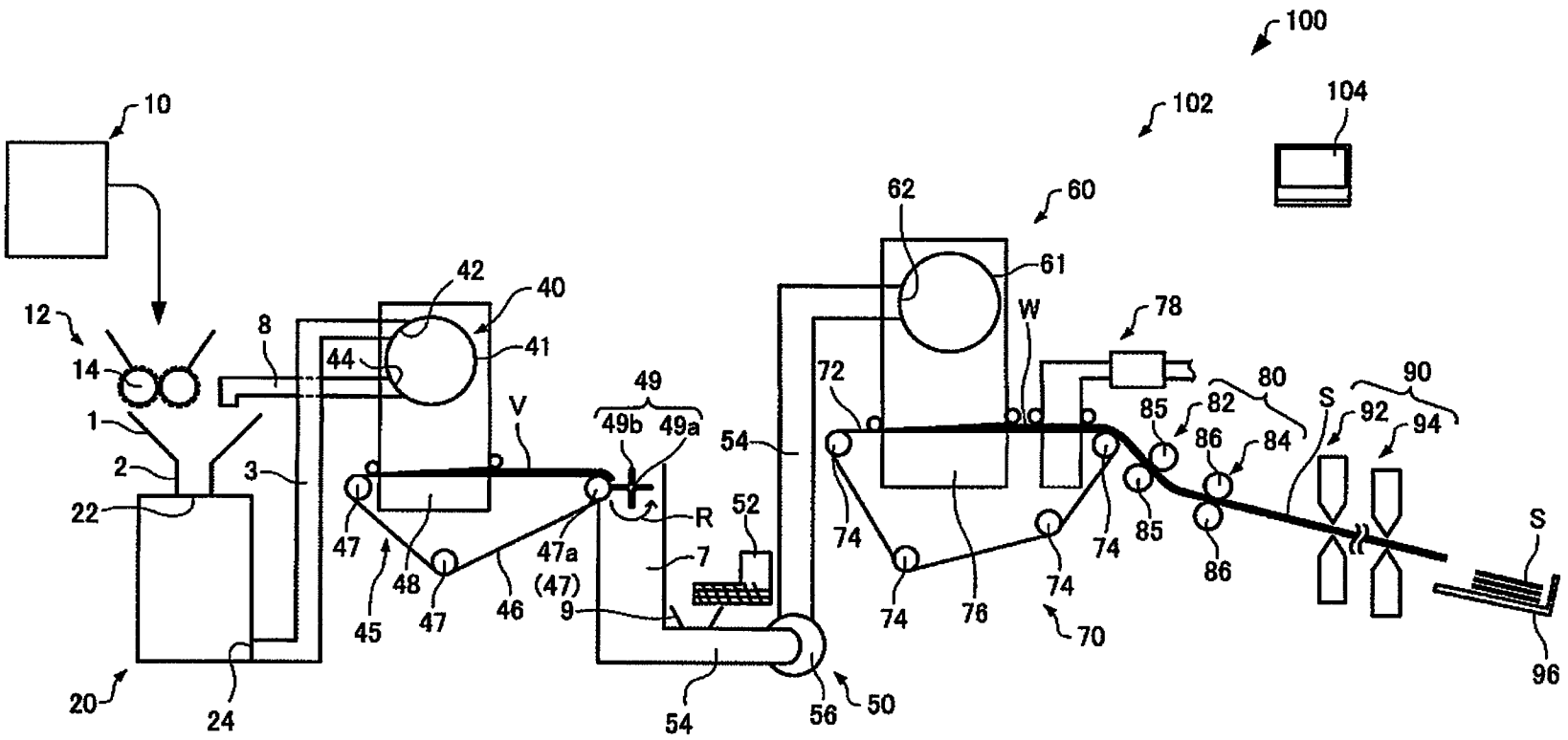
FIG. 1 illustrates a sheet manufacturing apparatus according to a first embodiment of the invention.

A sheet manufacturing apparatus according to a first embodiment is described below with reference to the accompanying figures. FIG. 1 schematically illustrates a sheet manufacturing apparatus 100 according to this first embodiment.

As shown in FIG. 1, the sheet manufacturing apparatus 100 has a supply unit 10, manufacturing unit 102, and control unit 104. The manufacturing unit 102 manufactures sheets. The manufacturing unit 102 includes a shredder 12, defibrating unit 20, separator 40, first web forming unit 45, rotor 49, mixing unit 50, air-laying unit 60, second web forming unit 70, sheet forming unit 80, and cutting unit 90.

The supply unit 10 supplies feedstock to the shredder 12. The supply unit 10 is, for example, an automatic loader for continuously supplying feedstock material to the shredder 12. The feedstock supplied by the supply unit 10 includes fiber from recovered paper or pulp sheets, for example.

The shredder 12 cuts feedstock supplied by the supply unit 10 into shreds in air. The shreds in this example are pieces a few centimeters in size. In the example in the figure, the shredder 12 has shredder blades 14, and shreds the supplied feedstockbythe shredder blades 14. In this example, a paper shredder is used as the shredder 12. The feedstock shredded by the shredder 12 is received into a hopper 1 and carried (conveyed) to the defibrating unit 20 through a conduit 2.

The defibrating unit 20 defibrates the feedstock shredded by the shredder 12. Defibrate as used here is a process of separating feedstock (material to be defibrated) comprising interlocked fibers into individual detangled fibers. The defibrating unit 20 also functions to separate particulate such as resin, ink, toner, and sizing agents in the feedstock from the fibers.

Material that has passed through the defibrating unit 20 is referred to as defibrated material. In addition to untangled fibers, the defibrated material may also contain resin particles (resin used to bind multiple fibers together), coloring agents such as ink and toner, sizing agents, paper strengthening agents, and other additives that are separated from the fibers when the fibers are detangled. The shape of the detangled defibrated material is a string or ribbon. The detangled, defibrated material may be separated from (not interlocked with) other detangled fibers, or may be in lumps interlocked with other detangled defibrated material (in so-called fiber clumps).

The defibrating unit 20 defibrates in a dry process in ambient air (air). More specifically, an impellermill is used as the defibrating unit 20. The defibrating unit 20 can also create an air flow that sucks in the feedstock and then discharges the defibrated material. As a result, the defibrating unit 20 can suction the feedstock with the air flow from the inlet 22, defibrate, and then convey the defibrated material to the exit 24 using the air flow produced by the defibrating unit 20. The defibrated material that has passed through the defibrating unit 20 is conveyed through a conduit 3 to the separator 40. Note that the air stream conveying the defibrated material from the defibrating unit 20 to the separator 40 may be the air current created by the defibrating unit 20, or a separate blower or other fan unit may be used to create the air current.

The separator 40 selects fibers by length from the defibrated material defibrated by the defibrating unit 20 that was introduced from the inlet 42. The separator 40 has a drum 41. A screen (sieve) is used as the drum 41. The drum 41 has mesh (filter, screen), and can separate fiber or particles that are smaller than the size of the openings in the mesh (that pass through the mesh, first selected material) from fiber, undefibrated shreds, and clumps that are larger than the openings in the mesh (that do not pass through the mesh, second selected material). For example, the first selected material is conveyed through a conduit 7 to the mixing unit 50. The second selected material is returned from the exit 44 through another conduit 8 to the defibrating unit 20. More specifically, the drum 41 is a cylindrical sieve that can be rotated by a motor. The mesh of the drum 41 may be a metal screen, expanded metal made by expanding a metal sheet with slits formed therein, or punched metal having holes formed by a press in a metal sheet.

The first web forming unit 45 conveys the first selected material from the separator 40 to the mixing unit 50. The first web forming unit 45 includes, for example, a mesh belt 46, tension rollers 47, and a suction unit (suction mechanism) 48.

The suction unit 48 suctions the first selected material that has passed through the openings (mesh openings) in the drum 41 and was dispersed in air onto the mesh belt 46. The first selected material accumulates on the moving mesh belt 46, forming a web V. The basic configuration of the mesh belt 46, tension rollers 47, and suction unit 48 are the same as the mesh belt 72, tension rollers 74, and suction mechanism 76 of the second web forming unit 70 described below.

The web V is a soft, fluffy web containing a lot of air as a result of passing through the separator 40 and first web forming unit 45. The web V formed on the mesh belt 46 is fed into a conduit 7 and conveyed to the mixing unit 50.

The rotor 49 cuts the web V before the web V is conveyed to the mixing unit 50. In the example in the figure, the rotor 49 has a base 49*a*, and blades 49*b* protruding from the base 49*a*. The blades 49*b* in this example have a flat shape. In the example in the figure, there are four blades 49*b*, and the four blades 49*b* are equally spaced around the base 49*a*. By the base 49*a* turning in direction R, the blades 49*b* rotate on the axis of the base 49*a*. By cutting the web V with the rotor 49, variation in the amount of defibratedmaterial per unit time supplied to the air-laying unit 60, for example, can be reduced.

The rotor 49 is disposed near the first web forming unit 45. In the example in the figure, the rotor 49 is disposed near a tension roller 47*a* (beside the tension roller 47*a*) located at the downstream side of the conveyance path of the web V. The rotor 49 is disposed at a position where the blades 49*b* can contact the web V but do not touch the mesh belt 46 on which the web V is laid. As a result, wear (damage) to the mesh belt 46 by the blades 49*b* can be suppressed. The minimum distance between the blades 49*b* and mesh belt 46 is preferably greater than or equal to 0.05 mm and less than or equal to 0.5 mm. for example.

The mixing unit 50 mixes an additive containing resin with the first selected material (the first selected material conveyed by the first web forming unit 45) that has passed through the separator 40. The mixing unit 50 has an additive supply unit 52 that supplies additive, a conduit 54 for conveying the selected material and additive, and a blower 56. In the example in the figure, the additive is supplied from the additive supply unit 52 through a hopper 9 to a conduit 54. Conduit 54 communicates with conduit 7.

The mixing unit 50 uses the blower 56 to produce an air flow, and can convey while mixing the selected material and additives in the conduit 54. Note that the mechanism for mixing the first selected material and additive is not specifically limited, and may mix by means of blades turning at high speed, or may use rotation of the container like a V blender.

A screw feeder such as shown in FIG. 1, or a disc feeder not shown, for example, may be used as the additive supply unit 52. The additive supplied from the additive supply unit 52 contains resin for binding multiple fibers together. The multiple fibers are not bound when the resin is supplied. The resin melts and binds multiple fibers when passing through the sheet forming unit 80.

The resin supplied from the additive supply unit 52 is a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive supplied from the additive supply unit 52 may be fibrous or powder.

Depending on the type of sheet being manufactured, the additive supplied from the additive supply unit 52 may also include a coloring agent for coloring the fiber, an anti-blocking suppressant agent to prevent fiber agglomeration, or a flame retardant for making the fiber difficult to burn, in addition to resin for binding fibers. The mixture (a mixture of first selected material and additive) that has passes through the mixing unit 50 is conveyed through a conduit 54 to the air-laying unit 60.

The mixture that has passed through the mixing unit 50 is introduced from the inlet 62 to the air-layingunit 60, which detangles and disperses the tangled defibrated material (fiber) in air while the mixture precipitates. When the resin in the additive supplied from the additive supply unit 52 is fibrous, the air-laying unit 60 also detangles interlocked resin fibers. As a result, the air-laying unit 60 can lay the mixture uniformly in the second web forming unit 70.

The air-laying unit 60 has a drum 61. A cylindrical sieve that turns is used as the drum 61. The drum 61 has mesh, and causes fiber and particles smaller than the size of the mesh (that pass through the mesh) and contained in the mixture that has passed through the mixing unit 50 to precipitate. The configuration of the drum 61 is the same as the configuration of drum 41 in this example.

Note that the sieve of the drum 61 may be configured without functionality for selecting specific material. More specifically, the "sieve" used as the drum 61 means a device having mesh, and the drum 61 may cause all of the mixture introduced to the drum 61 to precipitate.

The second web forming unit 70 lays the precipitate that has passed through the air-laying unit 60 into a web W. The web forming unit 70 includes, for example, a mesh belt 72, tension rollers 74, and a suction mechanism 76.

The mesh belt 72 is moving while precipitate that has passed through the holes (mesh) of the drum 61 accumulates thereon. The mesh belt 72 is tensioned by the tension rollers 74, and is configured so that air passes through but it is difficult for the precipitate to pass through. The mesh belt 72 moves when the tension rollers 74 turn. A web W is formed on the mesh belt 72 as a result of the mixture that has passed through the air-laying unit 60 precipitating continuously while the mesh belt 72 moves continuously. The mesh belt 72 may be metal, plastic, cloth, or nonwoven cloth.

The suction mechanism 76 is disposed below the mesh belt 72 (on the opposite side as the air-laying unit 60). The suction mechanism 76 produces a downward flow of air (air flow directed from the air-laying unit 60 to the mesh belt 72). The mixture distributed in air by the air-laying unit 60 can be pulled onto the mesh belt 72 by the suction mechanism 76. As a result, the discharge rate from the air-laying unit 60 can be increased. A downward air flow can also be created in the descent path of the mixture, and interlocking of defibrated material and additive during descent can be prevented, by the suction mechanism 76.

A soft, fluffy web W containing much air is formed by material passing through the air-laying unit 60 and second web forming unit 70 (web forming process) as described above. The web W laid on the mesh belt 72 is then conveyed to the sheet forming unit 80.

Note that a moisture content adjustment unit 78 for adjusting the moisture content of the web W is disposed in the example shown in the figure. The moisture content adjustment unit 78 adds water or water vapor to the web W to adjust the ratio of water to the web W.

The sheet forming unit 80 applies heat and pressure to the web W laid on the mesh belt 72, forming a sheet S. By applying heat to the mixture of defibrated material and additive contained in the web W, the sheet forming unit 80 can bind fibers in the mixture together through the additive (resin).

The sheet forming unit 80 includes a compression unit 82 that compresses the web W, and a heating unit 84 that heats the web W after being compressed by the compression unit 82. The compression unit 82 in this example comprises a pair of calender rolls 85 that apply pressure to the web W. Calendering reduces the thickness of the webW and increases the density of the web W. A heat roller (heating roller), hot press molding machine, hot plate, hot air blower, infrared heater, or flash fuser, for example, may be used as the heating unit 84. In the example in the figure, the heating unit 84 comprises a pair of heat rollers 86. By configuring the heating unit 84 with heat rollers 86, a sheet S can be formed while continuously conveying the web W, unlike when the heating unit 84 is configured with a flat press (flat press machine). The calender rolls 85 (compression unit 82) can apply greater pressure to the web W than the pressure that can be applied by the heat rollers 86 (heating unit 84). Note that the number of calender rolls 85 and heat rollers 86 is not specifically limited.

The cutting unit 90 cuts the sheet S formed by the sheet forming unit 80. In the example in the figure, the cutting unit 90 has a first cutter 92 that cuts the sheet S crosswise to the conveyance direction of the sheet S, and a second cutter 94 that cuts the sheet S parallel to the conveyance direction. In this example, the second cutter 94 cuts the sheet S after passing through the first cutter 92.

Cut sheets S of a specific size are formed by the process described above. The cut sheets S are then discharged to the discharge unit 96.

1.1.2. Air-Laying Unit and Humidifying Unit

Figure 2:
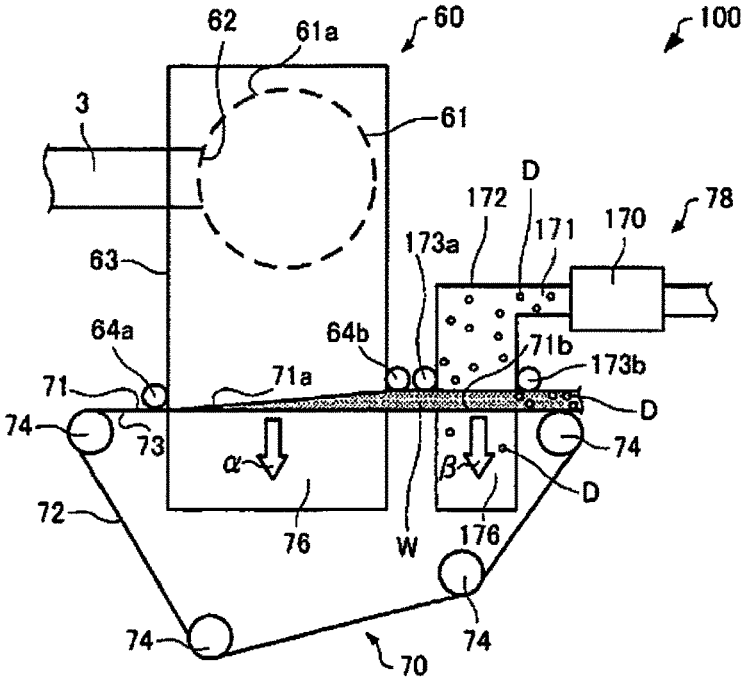
FIG. 2 illustrates a sheet manufacturing apparatus according to a first embodiment of the invention.

The air-laying unit 60 and moisture content adjustment unit (humidifying unit) 78 are described next. FIG. 2 is an enlarged view of FIG. 1 in the area around the air-laying unit 60 and humidifying unit 78.

The air-laying unit 60 lays material including fiber (defibrated material) and resin (an additive including resin). The air-laying unit 60, as shown in FIG. 2, includes a drum 61 (mesh) in which many holes 61*a* are formed, a first housing 63, rollers 64*a*, 64*b*, and a suction mechanism 76 (second air flow generator).

Note that the second air flow generator 76 is described in 1.1.1. Configuration above as including a second web forming unit 70, but the second web forming unit 70 may be considered part of the air-laying unit 60. The second air flow generator 76 may also be considered part of the air-laying unit 60, and not the second web forming unit 70.

The first housing 63 houses the drum 61, for example. The first housing 63 is shaped like a box capable of holding the drum 61, and has an opening facing the support surface 71 of the mesh belt 72. The first housing 63 defines the deposition area 71*a* for depositing material including the defibrated material and additive. Material including the defibrated material and additive that have passed through the holes in the drum 61 can be deposited on the support surface 71 within the deposition area 71*a* in the air-laying unit 60. The deposition area 71*a* is, for example, an area between rollers 64*a*, 64*b*, and more specifically is an area defined by the opening in the first housing 63 opposite the support surface 71.

Rollers 64*a*, 64*b* are connected to the first housing 63. More specifically, the rollers 64*a*, 64*b* are disposed touching the outside of the first housing 63. A sealant (in this example, a pile seal) is disposed to the outside of the first housing 63, and the rollers 64*a*, 64*b* may be disposed in contact with the pile seal. Roller 64*b* is located on the downstream side of the roller 64*a*. Note that downstream side as used here means the side to which the web W flows (the direction in which the web W proceeds toward the discharge unit 96). Roller 64*b* is a roller disposed to the exit of the web W from the first housing 63, and is a roller touching the web W (first roller).

Rollers 64*a*, 64*b* are, for example, metal rollers. More specifically, the material on the surface of the rollers 64*a*, 64*b* is aluminum in this example. The rollers 64*a*, 64*b* are urged by their own weight or an urging member such as a spring, for example, and touch the mesh belt 72 when the web W has not been deposited. The rollers 64*a*, 64*b* suppress material including the defibrated material and additive from leaking from gaps between the first housing 63 and mesh belt 72.

The second air flow generator 76 is disposed on the opposite side of the support surface 71 (the back side 73) as the mesh belt 72. The back side 73 (inside circumference side) is the side facing the opposite direction as the support surface 71 (outside circumference side). In the example in the figure, the second air flow generator 76 is disposed inside the space surrounded by the mesh belt 72. The second air flow generator 76 is disposed opposite the first housing 63 with the mesh belt 72 therebetween. The secondair flow-generator 76 produces a current $\alpha$ for depositing material including the defibrated material and additive on the support surface 71 of the mesh belt 72. The current $\alpha$ is an air flow in a direction intersecting the support surface 71, and is, for example, a current perpendicular to the support surface 71. In the example in the figure, the second air flow generator 76 is a suction device (second suction device) that suctions material passing through the holes 61*a* in the drum 61 onto the support surface 71 from the back side 73 side. The second air flow generator 76 may comprise, for example, a box below the mesh belt 72 with an opening facing the back side 73, and a suction blower that suctions air from inside the box. The suction blower creating the current $\alpha$ may be disposed inside the box, or disposed outside the box and connected to the box by a conduit.

The humidifying unit 78 humidifies the web W laid by the air-laying unit. The humidifying unit 78 includes a generator 170, second housing 172, rollers 173*a*, 173*b*, and a first air flow generator 176.

The generator 170 is disposed on the support surface 71 side. In the example in the figure, the generator 170 is disposed outside the area enclosed by the mesh belt 72. The generator 170 produces droplets Dora humidified air flow from the support surface 71 side. The generator 170 may produce the droplets D by ultrasonic waves. The generator 170 may, for example, apply ultrasonic waves of a frequency of 20 kHz to several MHz to a fluid (water), and produce fine droplets D of several nm to several μm diameter. The generator 170 may also produce steam to produce humidified air. Note that humidified air as used here means air of 70% to 100% relative humidity.

The second housing 172 is connected through a conduit 171 to the generator 170. The second housing 172 is on the support surface 71 side. The second housing 172 is, for example, shaped like a box, and has an opening facing the support surface 71 of the mesh belt 72. The second housing 172 defines the humidifying area 71*b* for humidifying the web W. The humidifying unit 78 can humidify the web W laid on the support surface 71 inside the humidifying area 71*b*. The humidifying area 71*b* is, for example, between rollers 173*a*, 173*b*, and more specifically is an area defined by the second housing 172 opening facing the support surface 71. The humidifying area 71*b* is downstream from the deposition area 71*a*.

Rollers 173*a*, 173*b* are connected to the second housing 172. More specifically, the rollers 173*a*, 173*b* are disposed contacting the outside of the second housing 172. A seal member (such as a pile seal) is disposed to the outside of the second housing 172, and the rollers 173*a*, 173*b* may be disposed in contact with the seal member. Roller 173*b* is downstream from roller 173*a*. Roller 173*a* is also downstream from roller 64*b*. Roller 173*b* is a roller disposed to the exit of the web W from the second housing 172, and a roller (second roller) touching the web W after humidifying by the humidifying unit 78.

Rollers 173*a*, 173*b* are urged by their own weight or an urging member such as a spring, for example, and touch the mesh belt 72 when the web W has not been formed on the mesh belt 72. The rollers 173*a*, 173*b* suppress leakage of droplets D and humidified air from the gap between the second housing 172 and mesh belt 72.

The surface free energy of roller 173*b* is less than the surface free energy of roller 64*b*. The surface free energy of roller 173*b* is also less than the surface free energy of rollers 64*a*, 173*a*. For example, if the surface of the roller 64*b* is aluminum or other metal, and the surface of the roller 173*b* is formed by a fluororesin such as PFA (perfluoroalkoxy alkane) or PTFE (polytetrafluoroethylene) the surface free energy of roller 173*b* can be made lower than the surface free energy of roller 64*b*.

Note that the surface free energy measures surface tension, is the force of tension between (holding together) two materials (solids, liquids, gases, molecules, atoms) in proximity, and is based on the force of a physical bond (intermolecular force, Van del Waals) and not a chemical bond (bonds forming the material itself). The surface free energy can be measured using known instruments, for example.

The first air flow generator 176 is disposed on the back side 73 of the mesh belt 72. In the example in the figure, the first air flow generator 176 is disposed in the area surrounded by the mesh belt 72. The first air flow generator 176 is disposed opposite the second housing 172 with the mesh belt 72 therebetween. The first air flow generator 176 produces a current β passing through the thickness of the web W. The current β flows in a direction intersecting the support surface 71, and is, for example, a current perpendicular to the support surface 71. The humidifying unit 78 supplies droplets D or humidified air to the web W by means of the current β produced by the first air flow generator 176. The droplets D or humidified air, for example, pass through the thickness of the web W by means of the current β. The weight of the droplets D supplied to the web W by the humidifying unit 78 is, for example, greater than or equal to 0.1% and less than or equal to 3% of the weight of the web W per unit volume of the web W. In the example in the figure, the first air flow generator 176 is a suction device (first vacuum device) that suctions droplets D or humidified air produced by the generator 170 from the back side 73. The first air flow generator 176 is disposed separately to the second air flow generator 76. The first air flow generator 176 may be configured by, for example, a box disposed below the mesh belt 72 with an opening facing the back side 73, and a suction blower that pulls air from inside the box. The suction blower that produces the current β may be disposed inside the box or outside the box and connected to the box by a conduit.

The speed of the current β produced by the first air flow generator 176 at the support surface 71 is less than the speed of the current α produced by the second air flow generator 76 at the support surface 71. Note that the speed of the current β produced by the first air flow generator 176 at the support surface 71 is the average speed of the current β passing through the support surface 71 at the humidifying area 71*b* (more specifically, the average speed of the current β passing through perpendicularly). The speed of the current α produced by the second air flow generator 76 at the support surface 71 is the average speed of the current α passing through the support surface 71 in the deposition area 71*a* (more specifically, the average speedof the current α passing through perpendicularly). In this example, the speed of the current β passing through the support surface 71 at the humidifying area 71*b* is, for example, greater than or equal to 0.05 m/s, 0.2 m/s. The speed of the current α produced by the second air flow generator 76 at the support surface 71 is, for example, 0.2 m/s, 5.0 m/s. The speed of currents α and β can be measured by an anemometer known from the literature. The control unit 104 may also control the air flow generators 76, 176 to adjust the speed of currents α and β. Note that the speed of the air current may also be referred to as the air speed.

Features of the sheet manufacturing apparatus 100 are described below.

In the sheet manufacturing apparatus 100, the humidifying unit 78 includes the first air flow generator 176, which produces current β, which is an air flow intersecting the support surface 71 that supports the depositedmaterial (web W) and passes through the web W, and supplies droplets D or humidified air to the web W by means of the current β produced by the first air flow generator 176. As a result, the sheet manufacturing apparatus 100 can humidify the web W to the inside by means of the current β, and can suppress the adhesion of droplets or moisture to just the surface of the web W. As a result, the sheet manufacturing apparatus 100 can humidify the web W uniformly through the thickness thereof, and can reduce the amount of droplets or moisture on the surface of the web W compared with simply spraying water droplets and humidifying the surface of the web W with water droplets or moisture. As a result, the sheet manufacturing apparatus 100 can suppress the web W from wrapping around roller 173*b*. Furthermore, because the web W humidified by droplets D or humidified air is can be compressed to high density when calendered in the compression unit 82 in the sheet manufacturing apparatus 100, bond strength between the defibrated fibers or between the defibratedmaterial and additive can be increased.

The sheet manufacturing apparatus 100 can also increase, by means of the current β, the amount of moisture (for example, the amount of droplets in the web W) per unit time in the web W near the back side 73 in particular. By using current β, the web W can be efficiently humidified to the inside.

In the sheet manufacturing apparatus 100, the air-laying unit 60 includes a first housing 63 that defines the deposition area 71*a* for depositing material including defibrated material and additive; and the humidifying unit 78 includes a second housing 172 defining the humidifying area 71*b* for humidifying the web W. The sheet manufacturing apparatus 100 can therefore suppress excessive humidifying of the inside of the first housing 63 by the humidifying unit 78, and a drop in the quality of the sheet S. For example, if the inside of the first housing 63 is humidified by the humidifying unit 78, the inside of the drum 61 may become humidified and material may clump, or the inside walls of the first housing 63 may become humidified and material may cling and clump thereto. At some point the clumped material may then precipitate onto the support surface 71, causing the thickness of the web W to vary and the quality of the sheet S to drop.

In the sheet manufacturing apparatus 100, the first air flow generator 176 is a first suction device disposed to the back side 73, and the air-laying unit 60 has a second air flow generator 76 that produces a current α for depositing material including defibrated material and additive on the support surface 71, and is disposed to the back side 73. As a result, the volume and the speed of current α, and the volume and speed of current β, can be set separately in the sheet manufacturing apparatus 100.

In the sheet manufacturing apparatus 100, the surface free energy of the second roller 173*b* is less than the surface free energy of the first roller 64*b*. As a result, even if the web W is humidified by the humidifying unit 78 and sticks easily to the rollers, the web W can be prevented from wrapping onto roller 173*b*. Note that if the surface free energy of the first roller 64*b* is set low like the surface free energy of the roller 173*b* (specifically, if the surface of the first roller 64*b* is PFA), cost increases and the roller 64*b* may be easily damaged (for example, the surface of the roller may wear).

In the sheet manufacturing apparatus 100, the speed of the current β produced by the first air flow generator 176 at the support surface 71 is less than the speed of the current α produced by the second air flow generator 76 at the support surface 71. As a result, the sheet manufacturing apparatus 100 can improve the quality of the sheet S while suppressing separation of the defibrated material and additive including resin. Furthermore, if the speed of current α is less than the speed of current β, for example, the air flow produced by rotation of the drum 61 may cause the thickness of the web W to vary and the quality of the sheet S to drop. For example, if the speed of current β is greater than the speed of current α, the defibrated material and additive that are held together by static electricity may be separated by the current β. As a result, bonding defibrated fibers together may be inhibited.

The sheet manufacturing apparatus 100 has a generator 170 that produces droplets D or humidified air from the support surface 71 side, and a first suction device (first air flow generator 176) that suctions from the back side 73 the droplets D or humidified air produced by the generator 170. As a result, the sheet manufacturing apparatus 100, by the current β produced by the first air flow generator 176, can supply droplets D or humidified air to the web W. As a result, the sheet manufacturing apparatus 100 can humidify the web W to the inside, can suppress droplets or moisture from adhering only to the surface of the web W, and as described above can suppress wrapping of the web W to the roller 173*b*.

A sheet manufacturing method according to the first embodiment of the invention uses the sheet manufacturing apparatus 100, for example. A sheet manufacturing method using the sheet manufacturing apparatus 100, as described above, includes a step of depositing material including fiber and resin, and a step of humidifying the laid web W, and in the step of humidifying the web W, supplies droplets D or humidified air to the web W by means of a current β passing through the web Win a direction intersecting the support surface 71 that supports the web W. As a result, the sheet manufacturing method using the sheet manufacturing apparatus 100 can suppress the web W from wrapping onto the roller 173*b*.

In the sheet manufacturing apparatus according to the invention, defibrated material that has passed through the defibrating unit 20 may be conveyed through the conduit 3 to a classifier (not shown in the figure). The classified material classified by the classifier may then be conveyed to the separator 40. The classifier classifies defibrated material that has passed through the defibrating unit 20. More specifically, the classifier separates and removes relatively small or low density material (such as resin particles, color agents, additives) from the defibrated material. As a result, the percentage of relatively large or high density fiber in the defibrated material can be increased. The classifier may be, for example, a cyclone, elbow joint, or eddy classifier.

2. Embodiment 2

2.1. Sheet Manufacturing Apparatus

Figure 3:
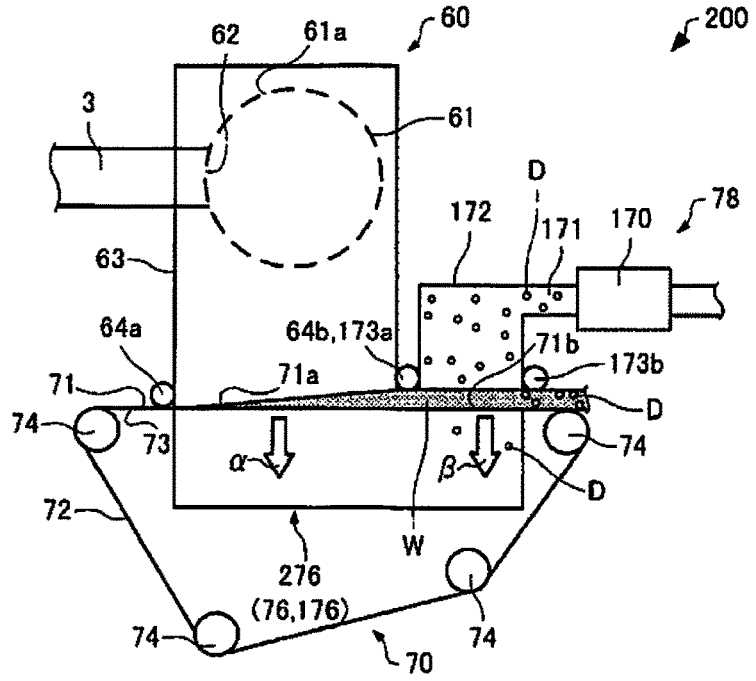
FIG. 3 illustrates a sheet manufacturing apparatus according to a second embodiment of the invention.

A sheet manufacturing apparatus according to a second embodiment of the invention is described next with reference to the accompanying figures. FIG. 3 schematically illustrates the sheet manufacturing apparatus 200 according to the second embodiment of the invention, and is an enlarged view of the same part shown in FIG. 2. Below, like parts in this sheet manufacturing apparatus 200 and the sheet manufacturing apparatus 100 described above are identified by like reference numerals, and further detailed description thereof is omitted.

As shown in FIG. 2, the sheet manufacturing apparatus 100 described above separates the first air flow generator 176 and second air flow generator 76. In the sheet manufacturing apparatus 200 according to this embodiment, however, the first air flow generator 176 and second air flow generator 76 are configured as a common suction device 276 disposed on the back side 73 as shown in FIG. 3. The first air flow generator 176 and second air flow generator 76 are rendered in unison. In the example in the figure, rollers 64*b*, and 173*a* are also configured as a single common roller.

In this sheet manufacturing apparatus 200, the first air flow generator 176 and second air flow generator 76 are configured as a common suction device 276. System size can therefore be reduced because the suction device can share the suction blower not shown (the part that produces the air flow for suction in the suction device) and conduits.

In this sheet manufacturing apparatus 200, rollers 64*b*, 173*a* are the same roller. As a result, device size can be reduced. While not shown in the figure, rollers 64*b*, 173*a* may be the same roller in the sheet manufacturing apparatus 100, too.

2.2. Variations of the Sheet Manufacturing Apparatus

Figure 4:
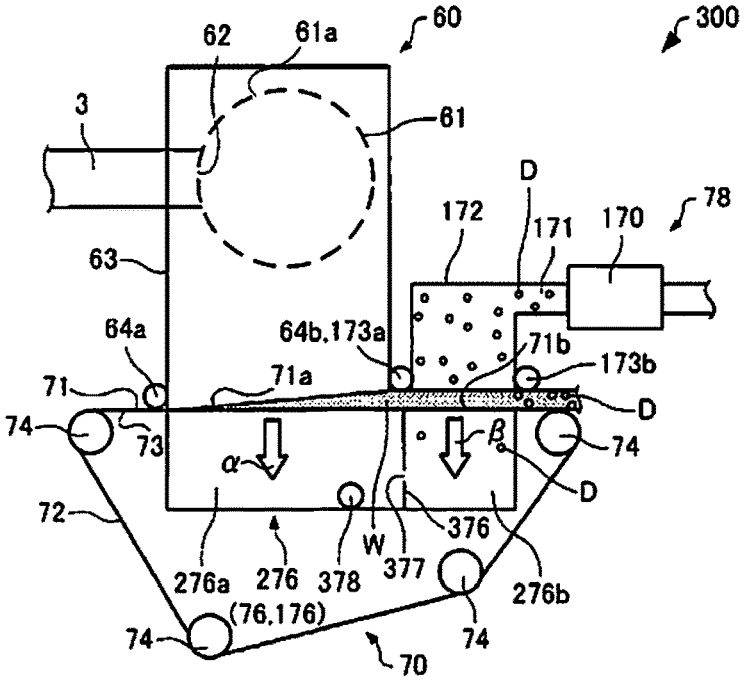
FIG. 4 illustrates a sheet manufacturing apparatus according to a variation of the second embodiment of the invention.

Sheet manufacturing apparatuses according to variations of the second embodiment are described next. FIG. 4 schematically illustrates a sheet manufacturing apparatus 300 according to a variation of the second embodiment of the invention, and is an enlarged view of the same part shown in FIG. 2. Below, like parts in this sheet manufacturing apparatus 300 and the sheet manufacturing apparatuses 100, 200 described above are identified by like reference numerals, and further detailed description thereof is omitted.

As shown in FIG. 4, this sheet manufacturing apparatus 300 differs from the sheet manufacturing apparatus 200 described above in having a divider 376 disposed inside the common suction device 276.

In this sheet manufacturing apparatus 300, the inside of the suction device 276 is separated by the divider 376 into a first chamber 276*a* and a second chamber 276*b*. The first chamber 276*a* is below the first housing 63, and the second chamber 276*b* is below the second housing 172. In the example in the figure, the divider 376 is a flat panel with an opening 377. The first chamber 276*a* and second chamber 276*b* communicate through the opening 377. A suction blower 378 is disposed in the first chamber 276*a*. The suction blower 378 is the part that produces suction currents α, β in the suction device 276. While not shown in the figures, the suction blower 378 may be disposed outside chambers 276*a* and 276*b*, and the suction blower 378 and first chamber 276*a* may be connected by a conduit.

In this sheet manufacturing apparatus 300, the inside of the suction device 276 is separated by the divider 376 into a first chamber 276*a* and a second chamber 276*b*, and an opening 377 formed in the divider 376 connects the first chamber 276*a* and second chamber 276*b*. A suction blower 378 is also disposed to the first chamber 276*a*. As a result, the speed of the current β can be adjusted by the location of the divider 376, and the location and size of the opening 377, and the velocity of the current β at the support surface 71 can be made less than the velocity of the current α at the support surface 71.

Figure 5:
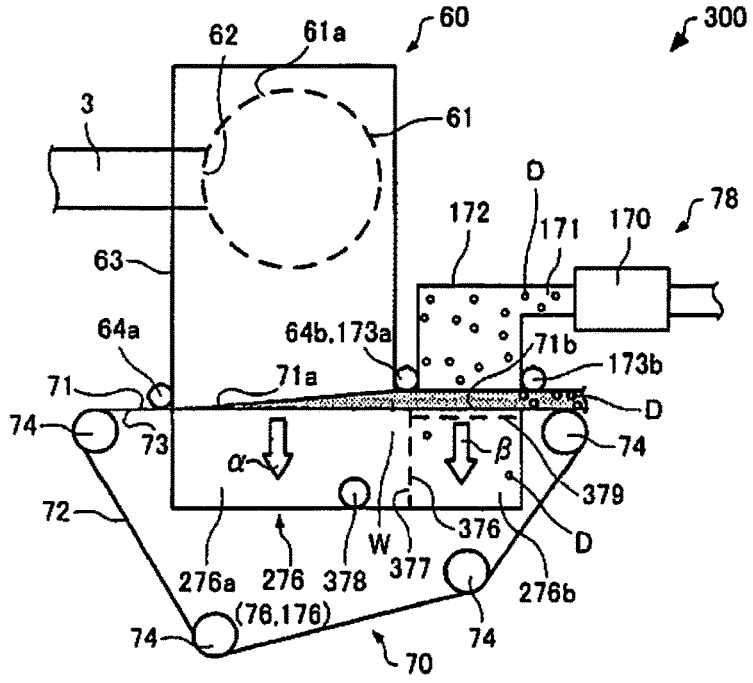
FIG. 5 illustrates a sheet manufacturing apparatus according to a variation of the second embodiment of the invention.

As indicated in FIG. 5, the divider 376 may be a foraminous mesh with many openings 377. As also shown in FIG. 5, a mesh member 379 opposite the back side 73 and forming the second chamber 276*b* may also be disposed. Furthermore, while not shown in the figures, a flat panel divider 376 and a mesh divider 376 may both be provided.

Note that a sheet S manufactured by the sheet manufacturing apparatus according to this embodiment refers primarily to a medium formed in a sheet. The invention is not limited to making sheets, however, and may produce board and web forms. Sheets as used herein include paper and nonwoven cloth. Paper includes products manufactured as thin sheets from pulp or recovered paper as the feedstock, and includes recording paper for handwriting or printing, wallpaper, wrapping paper, construction paper, drawing paper, and bristol. Nonwoven cloth may be thicker than paper and low strength, and includes common nonwoven cloth, fiber board, tissue paper (tissue paper for cleaning), kitchen paper, vacuum filter bags, filters, fluid (waste ink, oil) absorbers, sound absorbers, cushioning materials, and mats. The feedstock may include cellulose and other plant fiber, PET (polyethylene terephthalate), polyester, and other types synthetic fiber, wool, silk, and other types of animal fiber.

The invention may be configured to omit some of the configurations described above insofar as the features and effects described above are retained, and may combine aspects of different embodiments and examples. Note that as long as it can manufacture sheets, the manufacturing unit 102 maybemodified by omitting some configurations, adding other configurations, and substituting configurations known from the related art.

The invention includes configurations (such as configurations having the same function, method, and result, or configurations having the same purpose and effect) having effectively the same configuration as those described above. The invention also includes configurations that replace parts that are not essential to the configuration described in the foregoing embodiment. Furthermore, the invention includes configurations having the same operating effect, or configurations that can achieve the same objective, as configurations described in the foregoing embodiment. Furthermore, the invention includes configurations that add technology known from the literature to configurations described in the foregoing embodiment.

REFERENCE SIGNS LIST

1 hopper
2, 3, 4, 5, 7, 8 conduit
9 hopper
10 supply unit
12 shredder
14 shredder blades
20 defibrating unit
22 inlet port
24 discharge port
40 separator
41 drum unit
42 inlet port
44 discharge port
45 first web forming unit
46 mesh belt
47, 47*a* tension rollers
48 suction unit
49 rotor
49*a* base
49*b* blades
50 mixing unit
52 additive supply unit
54 conduit
56 blower
60 air-laying unit
61 drum unit
61*a* opening
62 inlet port
63 first housing
64*a*, 64*b* rollers
70 second web forming unit
71 support surface
71*a* deposition area
71*b* humidifying area
72 mesh belt
73 back side
74 tension rollers.
76 suction mechanism
78 moisture content adjustment unit
80 sheet forming unit
82 calender
84 heat unit
85 calender rolls
86 heat rollers
90 cutting unit
92 first cutting unit
94 second cutting unit
96 discharge unit
100 sheet manufacturing apparatus
102 manufacturing unit
104 controller
170 generator
171 conduit
172 second housing
173*a*, 173 brollers
176 first air flow generator
200 sheet manufacturing apparatus

276 suction device
276*a* first chamber
276*b* second chamber
300 sheet manufacturing apparatus
376 divider
377 opening
378 suction blower
379 mesh member
D droplets
R direction
S sheet
V, W web
α, β air flaw

The invention claimed is:

1. A sheet manufacturing apparatus comprising:

an air-laying unit that lays material containing fiber and resin;

a mesh belt on which the material is deposited by the air-laying unit;

a humidifying unit that humidifies, by droplets or humidified air, the deposited material on the mesh belt, the humidifying unit including a humidifying housing defining a humidifying area for humidifying the deposited material, a first air flow generator that generates air flow passing through the deposited material in a direction intersecting a support surface of the mesh belt, the supporting surface supporting the deposited material, the humidifying unit supplying the droplets or the humidified air to the deposited material by the air flow produced by the first air flow generator, and a roller contacting the deposited material on the mesh belt and contacting an outside of the humidifying housing so as to suppress leakage of the droplets or the humidified air from a gap between the humidifying housing and the mesh belt; and a sheet forming unit including a compression unit that is disposed downstream relative to the mesh belt in a transfer direction of the deposited material and compresses the deposited material that has been humified, to form a sheet, the air-laying unit having a second air flow generator configured to produce air flow causing the material to accumulate on the support surface, the velocity of the air flow produced at the support surface by the first air flow generator being less than the velocity of the air flow produced at the support surface by the second air flow generator.

2. The sheet manufacturing apparatus according to claim 1, wherein:

the air-laying unit has an air-laying housing that defines a deposition area for depositing the material.

3. The sheet manufacturing apparatus according to claim 2, wherein:

the first air flow generator is a first suction device disposed on the back side, which faces the opposite side as the support surface; and the second air flow generator is a second suction device disposed on the back side.

4. The sheet manufacturing apparatus according to claim 2, wherein:

the first air flow generator and second air flow generator are a common suction device disposed on the back side, which faces the opposite side as the support surface.

5. The sheet manufacturing apparatus according to claim 1, wherein:

the air-laying unit has a different roller that contacts the deposited material, the different roller is different form the roller of the humidifying unit; and the roller of the humidifying unit contacts the humidified deposited material; and the surface free energy of the roller of the humidifying unit is less than the surface free energy of the different roller of the air-laying unit.

6. A sheet manufacturing apparatus comprising:

an air-laying unit configured to lay material containing fiber and resin;

a mesh belt having a support surface on which the material is deposited by the air-laying unit;

a generator configured to produce droplets or humidified air from the support surface side;

a humidifying housing defining a humidifying area for humidifying deposited material laid by the air-laying unit;

a first air flow generator that generates air flow passing through the deposited material in a direction intersecting the support surface, the first air flow generator being a first suction device configured to suction the droplets or the humidified air produced by the generator, from the back side, which faces in an opposite direction of the support surface;

a roller contacting the deposited material on the support surface of the mesh belt and contacting an outside of the humidifying housing so as to suppress leakage of the droplets or the humidified air from a gap between the humidifying housing and the mesh belt; and a sheet forming unit including a compression unit that is disposed downstream relative to the mesh belt in a transfer direction of the deposited material and compresses the deposited material that has been humified, to form a sheet, the air-laying unit having a second air flow generator configured to produce air flow causing the material to accumulate on the support surface, the velocity of the air flow produced at the support surface by the first air flow generator being less than the velocity of the air flow produced at the support surface by the second air flow generator.

7. The sheet manufacturing apparatus according to claim 6, wherein:

the air-laying unit has a foraminous drum unit, and the second air flow generator is a second suction device configured to suction, from the back side, material that has passed through openings in the drum unit.

8. A sheet manufacturing method comprising:

laying material containing fiber and resin on a mesh belt; and humidifying, by droplets or humidified air, the deposited material by a humidifying unit, the humidifying unit having a humidifying housing and a roller, the humidifying housing defining a humidifying area for humidifying the deposited material, the roller contacting the deposited material on the mesh belt and contacting an outside of the humidifying housing so as to suppress leakage of the droplets or the humidified air from a gap between the humidifying housing and the mesh belt, the humidifying of the deposited material being performed by supplying the droplets or the humidified air to the deposited material by generating, by a first air flow generator, air flow passing through the deposited material in a direction intersecting a support surface of the mesh belt, the support surface supporting the deposited material; and forming a sheet by compressing the deposited material that has been humified, by a compression unit that is disposed downstream relative to the mesh belt in a transfer direction of the deposited material, the laying of the material being performed by using air flow that is produced by a second air flow generator and that causes the material to accumulate on the support surface of the mesh belt, the velocity of the air flow produced at the support surface by the first air flow generator being less than the velocity of the air flow produced at the support surface by the second air flow generator.

9. The sheet manufacturing apparatus according to claim 1, wherein:

the roller of the humidifying unit contacts the humidified deposited material and has a surface formed of a fluororesin.

* * * * *